US006701732B2

(12) United States Patent
Shimoda

(10) Patent No.: US 6,701,732 B2
(45) Date of Patent: Mar. 9, 2004

(54) AIR CONDITIONER

(75) Inventor: Junichi Shimoda, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/181,352

(22) PCT Filed: Nov. 13, 2001

(86) PCT No.: PCT/JP01/09927

§ 371 (c)(1),
(2), (4) Date: Jul. 17, 2002

(87) PCT Pub. No.: WO02/39025

PCT Pub. Date: May 16, 2002

(65) Prior Publication Data

US 2003/0010047 A1 Jan. 16, 2003

(30) Foreign Application Priority Data

Nov. 13, 2000 (JP) ..... 2000-345580

(51) Int. Cl.[7] ..... F25B 41/00; F25B 1/00
(52) U.S. Cl. ..... 62/228.3; 62/209
(58) Field of Search ..... 62/228.3, 228.1, 62/228.5, 229, 208, 209, 199, 200

(56) References Cited

U.S. PATENT DOCUMENTS 5,077,982 A * 1/1992 Shaffer, Jr. ..... 62/199
5,142,877 A * 9/1992 Shimizu ..... 62/129
5,237,833 A * 8/1993 Hayashida et al. ..... 62/324.6
6,026,654 A * 2/2000 Park ..... 62/199

FOREIGN PATENT DOCUMENTS

JP 5-93540 A 4/1993
JP 6-109311 A 4/1994
JP 8-219530 A 8/1996

* cited by examiner

*Primary Examiner*—Marc Norman
(74) *Attorney, Agent, or Firm*—Nixon Peabody LLP; Donald R. Studebaker

(57) ABSTRACT

A refrigerant circuit (15) is disposed which is formed by connection of an outdoor unit (11) and two indoor units (12, 13). And, the air conditioning capacity of the outdoor unit (11) is controlled such that the temperature of refrigerant circulating through the refrigerant circuit (15) becomes a target value and the target value is altered correspondingly to the state of an operation. In other words, the control characteristics of the target value are determined correspondingly to the air conditioning load characteristics of a building, and the target value is altered according to the control characteristics and based on the inside/outside temperature difference between an indoor set temperature and an outside air temperature. For example, during cooling mode operations, the control characteristics of an evaporating temperature target value are determined correspondingly to the cooling load characteristics of the building and thereafter the evaporating temperature target value is altered according to the control characteristics and based on the inside/outside temperature difference. And, the air conditioning capacity of the outdoor unit (11) is controlled such that an evaporating temperature that a low-pressure pressure sensor (74) detects becomes a target value.

21 Claims, 8 Drawing Sheets

AIR CONDITIONER

TECHNICAL FIELD

The present invention relates to air conditioning systems. More particularly, this invention relates to measures to control air conditioning capacity.

BACKGROUND ART

A conventional multi type air conditioning system in which a plurality of indoor units are connected to a single outdoor unit, such as one disclosed in Japanese Patent Kokai Publication No. H02-230063, has been known.

The indoor unit comprises a first compressor which inverter controls capacity and a second compressor which controls capacity by means of an unload mechanism. And the outdoor unit adjusts the capacity of air conditioning by controlling the capacity of each of the two compressors.

In other words, during cooling mode operations, the capacity of each of the two compressors is controlled such that evaporating temperature becomes a given value, whereas, during heating mode operations, the capacity of each of the two compressors is controlled such that condensing temperature becomes a given value.

On the other hand, the indoor unit adjusts the capacity of cooling by performing control so that the degree of superheating becomes constant, for example during cooling mode operations.

Problems that the Invention Intends to Solve

In the above-described conventional air conditioning system, the air conditioning capacity of the outdoor unit is controlled such that evaporating temperature or condensing temperature maintains a constant value all the time. In other words, in conventional air conditioning systems, the air conditioning capacity of an outdoor unit is controlled so as to maintain a plurality of indoor units in such a state that each indoor unit is able to continuously exhibit a respective specified air conditioning capacity.

In the foregoing air conditioning system, the evaporating temperature or the condensing temperature is held at a fixed value. This means that, even when it is sufficient for an indoor unit to operate at a less air conditioning capacity, the outdoor unit is operated at a great air conditioning capacity.

Therefore, even when the air conditioning load is small during for example an intermediate period, the indoor unit operates at the same air conditioning capacity as when the air conditioning load is at its maximum, thereby resulting in an excess of capacity.

As a result of the above, the frequency at which the indoor unit is repeatedly operated and stopped becomes higher. This produces problems, that is, room temperature varies greatly and the capacity of compressors becomes unstable.

Further, the frequency at which the compressor is repeatedly driven and stopped becomes higher, which causes the drop in durability due to stress produced when the compressor is driven or stopped.

Furthermore, the excess of air conditioning capacity produces problems such as a poor operating efficiency and an uneconomical operation.

Bearing in mind the above-mentioned problems, the present invention was made. Accordingly, an object of the present invention is to suppress air conditioning capacity excess and to reduce both the frequency at which a utilization unit is repeatedly operated and shut down and the frequency at which a compressor is repeatedly driven and shut down.

DISCLOSURE OF THE INVENTION

The present invention is an invention for variably controlling the control target value of a heat source unit.

More specifically, the first invention is directed to an air conditioning system for providing air conditioning, the air conditioning system comprising a refrigerant circuit (15) formed by connection of a heat source unit (11) and a plurality of utilization units (12, 13, . . . ). In this invention, the air conditioning capacity of the heat source unit (11) is controlled such that a physical quantity of refrigerant circulating through the refrigerant circuit (15) becomes a target value, and wherein the target value is altered and set.

Further, the second invention is directed to an air conditioning system for providing air conditioning, the air conditioning system comprising a refrigerant circuit (15) formed by connection of a heat source unit (11) and a plurality of utilization units (12, 13, . . . ). The second invention further comprises a capacity controlling means (91) for controlling the air conditioning capacity of the heat source unit (11) so that a physical quantity of refrigerant becomes a target value, and a target value adjusting means (92) for altering the target value of the capacity controlling means (91).

Further, the third invention is an invention according to the second invention in which the target value adjusting means (92) is configured so as to variably control the target value correspondingly to the air conditioning load characteristics of a building.

Further, the fourth invention is an invention according to the second invention in which the target value adjusting means (92) is configured so as to variably control, according to the control characteristics of the target value and based on the temperature difference between a set temperature of an air conditioning space and an outside temperature, the target value.

Further, the fifth invention is an invention according to the second invention in which the target value adjusting means (92) includes a deciding means (93) for determining the control characteristics of the target value correspondingly to the air conditioning load characteristic a building, and an altering means (94) for variably controlling, according to the target value control characteristics determined by the deciding means (93) and based on the temperature difference between a set temperature of an air conditioning space and an outside temperature, the target value.

Further, the sixth invention is an invention according to any one of the first to fifth inventions in which during cooling mode operations the refrigerant physical quantity is an evaporating pressure.

Further, the seventh invention is an invention according to any one of the first to fifth inventions in which during cooling mode operations the refrigerant physical quantity is an evaporating temperature.

Further, the eighth invention is an invention according to any one of the first to fifth inventions in which during heating mode operations the refrigerant physical quantity is a condensing pressure.

Further, the ninth invention is an invention according to any one of the first to fifth inventions in which during heating mode operations the refrigerant physical quantity is a condensing temperature.

Further, the tenth invention is an invention according to any one of the first to fifth inventions in which the air conditioning capacity of the heat source unit (11) is controlled by controlling the capacity of each compressor (41, 42) of the heat source unit (11).

Further, the eleventh invention is an invention according to either the third invention or the fifth invention in which the building load characteristics are determined based on the amount of internal heat generation of the building and the amount of external heat.

Further, the twelfth invention is an invention according to the fifth invention in which a temperature detecting means (74) for the detection of refrigerant evaporating temperatures during cooling mode operations is provided. And, the capacity controlling means (91), which takes as a refrigerant evaporating temperature a target value during cooling mode operations, is configured to control the air conditioning capacity of the heat source unit (11) so that an evaporating temperature that the temperature detecting means (74) detects becomes the target value. In addition, the deciding means (93) of the target value adjusting means (92) is configured so as to determine the control characteristics of the target value of the evaporating temperature. Furthermore, the altering means (94) of the target value adjusting means (92) is configured so as to variably control the target value of the evaporating temperature.

Further, the thirteenth invention is an invention according to the fifth invention in which a temperature detecting means (76) for the detection of refrigerant condensing temperatures during heating mode operations is provided. And, the capacity controlling means (91), which takes as a refrigerant condensing temperature a target value during heating mode operations, is configured to control the air conditioning capacity of the heat source unit (11) so that a condensing temperature that the temperature detecting means (76) detects becomes the target value. In addition, the deciding means (93) of the target value adjusting means (92) is configured so as to determine the control characteristics of the target value of the condensing temperature. Furthermore, the altering means (94) of the target value adjusting means (92) is configured so as to variably control the target value of the condensing temperature.

Further, the fourteenth invention is an invention according to any one of the fourth, fifth, twelfth, and thirteenth inventions in which the target value adjusting means (92) is configured such that the target value control characteristics are set manually.

Further, the fifteenth invention is an invention according to any one of the fourth, fifth, twelfth, and thirteenth inventions in which the target value adjusting means (92) is configured such that the target value control characteristics are set based on an input signal fed from external setting means **(9*b*) via a communication line (9*a*)**.

Further, the sixteenth invention is an invention according to any one of the fourth, fifth, twelfth, and thirteenth inventions in which the target value adjusting means (92) is configured such the target value control characteristics are automatically set by learning according to the state of an operation during air conditioning.

Finally, the seventeenth invention is an invention according to the sixteenth invention in which the deciding means (93) of the target value adjusting means (92) is configured such that the target value control characteristics are set by learning according to the number of times air conditioning operation is brought to a halt.

To sum up, in accordance with the present invention, refrigerant circulates between the heat source unit (11) and the utilization units (12, 13, . . . ) for providing air conditioning. And, during air conditioning operations, the air conditioning capacity of the heat source unit (11) is controlled such that a physical quantity of refrigerant in the refrigerant circuit (15) becomes a target value and the target value is altered and set.

More specifically, for example, during cooling mode operations, the target value adjusting means (92) determines the control characteristics of an evaporating temperature target value, and the evaporating temperature target value or evaporating pressure target value is altered.

Further, during heating mode operations, the target value adjusting means (92) determines the control characteristics of a condensing temperature target value, and the condensing temperature target value or condensing pressure target value is altered.

When such a target value is altered, the capacity controlling means (91) takes a refrigerant evaporating temperature or a refrigerant condensing temperature as a target value and controls the air conditioning capacity of the heat source unit (11) in such a way that either an evaporating temperature that the temperature detecting means (74) detects or a condensing temperature that the temperature detecting means (76) detects becomes a target value. For example, compressor capacity is controlled such that the evaporating temperature or the condensing temperature becomes a target value.

Further, in the deciding means (93) of the target value adjusting means (92), either a target value control characteristic is manually set, a target value control characteristic is set based on an input signal fed from the external setting means **(9*b*) via the communication line (9*a*)**, or a target value control characteristic is automatically set by learning according to the state of an operation during air conditioning.

Effects of the Invention

Therefore, in accordance with the present invention, it is arranged such that a refrigerant temperature target value is altered based on an air conditioning load of a building for controlling the air conditioning capacity of the heat source unit (11), thereby making it possible to perform operations at a corresponding air conditioning capacity to the building air conditioning load.

That is, when it is sufficient for the utilization units (12, 13, . . . ) to operate at a less air conditioning capacity, the heat source unit (11) also can be operated at a less air conditioning capacity.

As a result, the utilization units (12, 13, . . . ) can be prevented from being operated at an excessive capacity during for example an intermediate period. Because of this, it is possible to reduce the frequency at which the utilization units (12, 13, . . . ) are repeatedly operated and shut down. And, in addition to making it possible to reduce variation in the temperature of an air conditioning space, compressor capacity can be made stable.

Further, since the frequency at which the compressors (41, 42) are repeatedly driven and shut down is reduced, this reduces stress which is produced when they are driven or shut down, thereby improving the durability of the compressors (41, 42).

Furthermore, since it is possible to suppress an excess of air conditioning capacity, this improves operating efficiency. As a result, COP (Coefficient Of Performance) is improved and improvements in economy can be achieved.

Further, in accordance with either the fourth invention or the fifth invention, the target value is altered depending on the temperature difference between a set temperature and an outside temperature, whereby air conditioning capacity can be increased for example at the beginning of an operation. For example, if the indoor temperature is higher than a set temperature during cooling mode operations, or if the indoor temperature is lower than a set temperature during heating mode operations, this increases the temperature difference between either refrigerant evaporating temperature or refrigerant condensing temperature and indoor suction air temperature, thereby making it possible to provide an increased air conditioning capacity. As a result, it is possible to provide improved comfortability Further, when there occurs sudden variation in load, the air conditioning capacity can be increased by making a change in the set temperature. This makes it possible to improve comfortability.

Furthermore, when performing air conditioning by introducing outdoor air, the air conditioning capacity will vary depending on the inside/outside temperature difference, thereby further improving comfortability. For example, an air conditioning capacity required to meet a set blow-out temperature is determined by the temperature difference between suction air temperature and set blow-out air temperature. Because of this, it is possible for the heat source unit (11) to control a required minimum capacity, thereby making it possible to improve COP and extend the range of controllable operations.

Further, if it is arranged such that the target value control characteristic described above can be manually set, an air conditioning capacity to meet the comfortability of a resident can be exhibited. This certainly improves comfortability.

Furthermore, if it is arranged such that the target value control characteristic described above can be learned, then a corresponding air conditioning capacity to the air conditioning load of a building can be set automatically. This provides further improvements in economy and comfortability.

BEST MODE FOR CARRYING OUT THE INVENTION

Hereinafter, an embodiment of the present invention will be described in detail with reference to the accompanying drawings.

Figure 1:
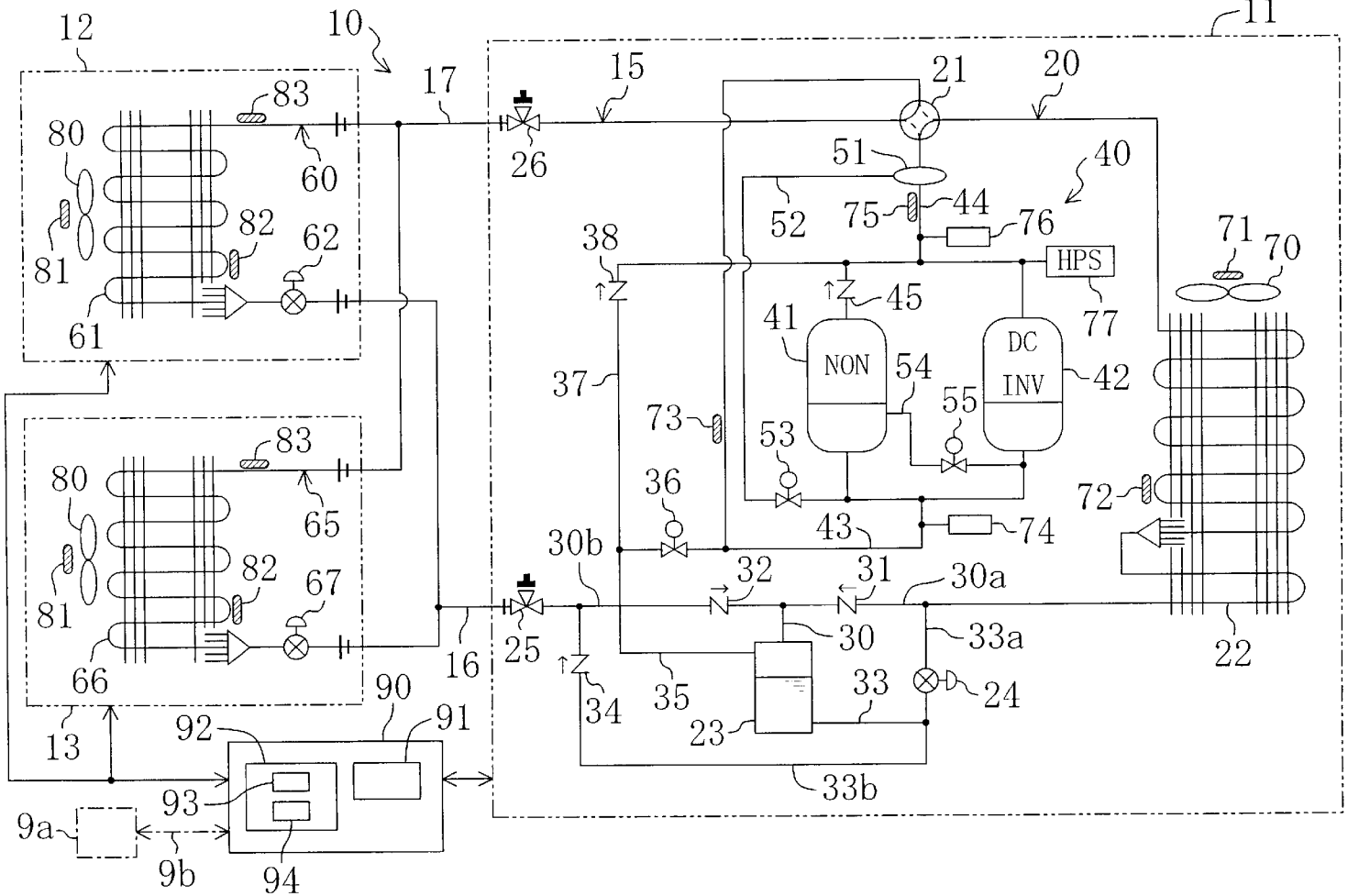
FIG. 1 is a refrigerant circuit showing an embodiment of the present invention.

As seen in FIG. 1, an air conditioning system (10) of the present embodiment comprises a single outdoor unit (11) and two indoor units (12, 13), in other words the air conditioning system (10) has a so-called multi type construction. The air conditioning system (10) is configured such that its operation is switchable between a cooling mode and a heating mode, and includes a refrigerant circuit (15) and a controller (90).

The present embodiment employs the two indoor units (12, 13), which should be deemed as one example. Accordingly, in the air conditioning system (10) of the present invention, the numbers of the indoor units (12, 13) may be determined depending on the capacity and the application of the outdoor unit (11).

The refrigerant circuit (15) is made up of a single outdoor circuit (20), two indoor circuits (60, 65), a liquid side connecting pipe (16), and a gas side connecting pipe (17). The two indoor circuits (60, 65) are connected in parallel to the outdoor circuit (20) through the liquid side connecting pipe (16) and through the gas side connecting pipe (17), respectively. The liquid side connecting pipe (16) and the gas side connecting pipe (17) constitute connecting piping.

The outdoor circuit (20) is housed in the outdoor unit (11) which is an outdoor machine. The outdoor unit (11) constitutes a heat source unit whereas the outdoor circuit (20) constitutes a heat source side circuit. The outdoor circuit (20) includes a compressor unit (40), a four-way selector valve (21), an outdoor heat exchanger (22), an outdoor expansion valve (24), a receiver (23), a liquid side shutoff valve (25), and a gas side shutoff valve (26).

The compressor unit (40) is formed by connecting a first compressor (41) and a second compressor (42) in a parallel arrangement. Each compressor (41, 42) is formed by placing a compression mechanism and an electric motor for driving the compression mechanism in a cylindrical housing. Neither the compression mechanism nor the electric motor is shown.

The first compressor (41) is a compressor of a fixed capacity type in which an electric motor is driven continuously at a fixed number of revolutions. On the other hand, the second compressor (42) is a compressor of a variable capacity type in which the number of revolutions of an electric motor is changed step by step or continuously. And, the compressor unit (40) is configured such that the capacity of the entire unit can be made variable by the driving and shutdown of the first compressor (41) and by making changes in the capacity of the second compressor (42).

Connected to the compressor unit (40) are a suction pipe (43) and a discharge pipe (44). One end of the suction pipe (43) is connected to a first port of the four-way selector valve (21), whereas the other end thereof diverges into two branches which are connected to suction sides of the compressors (41, 42), respectively. One end of the discharge pipe (44) diverges into two branches which are connected to discharge sides of the compressors (41, 42), respectively, whereas the other end thereof is connected to a second port of the four-way selector valve (21). One of the branch pipes of the discharge pipe (44) that is connected to the first compressor (41) is provided with a discharge side check valve (45). This discharge side check valve (45) allows only flow of a refrigerant flowing out from the first compressor (41).

Further, the compressor unit (40) includes an oil separator (51), an oil return pipe (52), and an oil amount averaging pipe (54). The oil separator (51) is disposed midway along the discharge pipe (44). The oil separator (51) serves to separate refrigerating machine oil from refrigerant discharged from the compressors (41, 42). One end of the oil return pipe (52) is connected to the oil separator (51), whereas the other end thereof is connected to the suction pipe (43). The oil return pipe (52) serves to return refrigerating machine oil separated in the oil separator (51) to the suction sides of the compressors (41, 42) and includes an oil return solenoid valve (53). One end of the oil amount averaging pipe (54) is connected to the first compressor (41), whereas the other end thereof is connected to a portion of the suction pipe (43) in the vicinity of the suction side of the second compressor (42). The oil amount averaging pipe (54) serves to average the amounts of refrigerating machine oil stored in the housings of the compressors (41, 42) and includes an oil amount averaging solenoid valve (55).

A third port of the four-way selector valve (21) is piping connected to the gas side shutoff valve (26). A fourth port of the four-way selector valve (21) is piping connected to an upper end of the outdoor heat exchanger (22). The four-way selector valve (21) is switchable between a state in which the first port and the third port communicate with each other while the second port and the fourth port communicate with each other (indicated by a solid line in FIG. 1) and a state in which the first port and the fourth port communicate with each other while the second port and the third port communicate with each other (indicated by a broken line in FIG. 1). By virtue of the switching operation of the four-way selector valve (21), the direction in which refrigerant in the refrigerant circuit (15) circulates is reversed.

The receiver (23) is a reservoir shaped like a cylinder and stores therein refrigerant. The receiver (23) is connected, through an inflow pipe (30) and an outflow pipe (33), to the outdoor heat exchanger (22) and the liquid side shutoff valve (25).

One end of the inflow pipe (30) diverges into two branch pipes (30*a*, 30*b*), whereas the other end thereof is connected to an upper end of the receiver (23). The first branch pipe (30*a*) of the inflow pipe (30) is connected to a lower end of the outdoor heat exchanger (22). The first branch pipe (30*a*) is provided with a first inflow check valve (31). The first inflow check valve (31) allows flow of refrigerant only from the outdoor heat exchanger (22) toward the receiver (23). The second branch pipe (30*b*) of the inflow pipe (30) is connected to the liquid side shutoff valve (25). The second branch pipe (30*b*) is provided with a second inflow check valve (32). The second inflow check valve (32) allows flow of refrigerant only from the liquid side shutoff valve (25) toward the receiver (23).

One end of the outflow pipe (33) is connected to a lower end of the receiver (23), whereas the other end thereof diverges into two branch pipes (33*a*, 33*b*). The first branch pipe (33*a*) of the outflow pipe (33) is connected to a lower end of the outdoor heat exchanger (22). The first branch pipe (33*a*) is provided with the outdoor expansion valve (24). The outdoor expansion valve (24) constitutes a heat source side expansion mechanism. The second branch pipe (33*b*) of the outflow pipe (33) is connected to the liquid side shutoff valve (25). The second branch pipe (33*b*) is provided with an outflow check valve (34). The outflow check valve (34) allows flow of refrigerant only from the receiver (23) toward the liquid side shutoff valve (25).

The outdoor heat exchanger (22) constitutes a heat source side heat exchanger. The outdoor heat exchanger (22) is implemented by a fin and tube type heat exchanger of a cross fin system. In the outdoor heat exchanger (22), heat exchange takes place between refrigerant circulating through the refrigerant circuit (15) and outdoor air.

Further, the outdoor circuit (20) is provided with a gas vent pipe (35) and a pressure equalizing pipe (37).

One end of the gas vent pipe (35) is connected to the upper end of the receiver (23), whereas the other end thereof is connected to the suction pipe (43). The gas vent pipe (35) constitutes a communication passage for introducing gas refrigerant in the receiver (23) to the suction sides of the compressors (41, 42). Further, the gas vent pipe (35) is provided with a gas vent solenoid valve (36). The gas vent solenoid valve (36) constitutes an opening/closing mechanism for connecting and disconnecting flow of gas refrigerant in the gas vent pipe (35).

One end of the pressure equalizing pipe (37) is connected to the gas vent pipe (35) between the gas vent solenoid valve (36) and the receiver (23), whereas the other end thereof is connected to the discharge pipe (44). Further, the pressure equalizing pipe (37) is provided with a check valve (38) for pressure equalization operable to allow flow of refrigerant only from one end thereof toward the other end. If there occurs an abnormal increase in outside temperature when the air conditioning system (10) is out of operation, this may cause the pressure of the receiver (23) to become excessively high. In such a case, the pressure equalizing pipe (37) prevents, by relief of gas refrigerant, the receiver (23) from bursting. During the operation of the air conditioning system (10), no refrigerant flows through the pressure equalizing pipe (37).

The indoor circuits (60, 65) are provided in the indoor units (12, 13), respectively. More specifically, the first indoor circuit (60) is housed in the first indoor unit (12) and the second indoor circuit (65) is housed in the second indoor unit (13).

Each of the indoor units (12, 13) constitutes a utilization unit and each of the indoor circuits (60, 65) constitutes a utilization side circuit.

The first indoor circuit (60) is formed by series-connecting the first indoor heat exchanger (61) and the first indoor expansion valve (62). The first indoor expansion valve (62) is piping connected to a lower end of the first indoor heat exchanger (61), constituting a utilization side expansion mechanism. The second indoor circuit (65) is formed by series-connecting the second indoor heat exchanger (66) and the second indoor expansion valve (67). The second indoor expansion valve (67) is piping connected to a lower end of the second indoor heat exchanger (66), constituting a utilization side expansion mechanism.

The first indoor heat exchanger (61) and the second indoor heat exchanger (66) each constitute a utilization side heat exchanger. Each indoor heat exchanger (61, 66) is implemented by a fin and tube type heat exchanger of a cross fin system. In each indoor heat exchanger (61, 66), heat exchange takes place between refrigerant in the refrigerant circuit (15) and indoor air.

One end of the liquid side connecting pipe (16) is connected to the liquid side shutoff valve (25). The other end of the liquid side connecting pipe (16) diverges into two branches one of which is connected to an end of the first indoor circuit (60) on the side of the first indoor expansion valve (62) and the other of which is connected to an end of the second indoor circuit (65) on the side of the second indoor expansion valve (67). One end of the gas side connecting pipe (17) is connected to the gas side shutoff valve (26). The other end of the gas side connecting pipe (17) diverges into two branches one of which is connected to an end of the first indoor circuit (60) on the side of the first indoor heat exchanger (61) and the other of which is connected to an end of the second indoor circuit (65) on the side of the second indoor heat exchanger (66).

The outdoor unit (11) is provided with an outdoor fan (70). The outdoor fan (70) serves to deliver outdoor air to the outdoor heat exchanger (22). Each of the first indoor unit (12) and the second indoor unit (13) is provided with an indoor fan (80). The indoor fans (80) serve to deliver indoor air to the indoor heat exchangers (61, 66).

The air conditioning system (10) is provided with a temperature sensor, a pressure sensor, and other sensors. More specifically, the outdoor unit (11) is provided with an outside air temperature sensor (71) for outside air temperature detection. The outdoor heat exchanger (22) is provided with an outdoor heat exchanger temperature sensor (72) for heat transfer pipe temperature detection. The suction pipe (43) is provided with a suction pipe temperature sensor (73) for detecting the temperature of refrigerant which is drawn in the compressors (41, 42), and a low-pressure pressure sensor (74) which detects the pressure of refrigerant which is drawn in the compressor (41, 42) and which constitutes a temperature detecting means. The discharge pipe (44) is provided with a discharge pipe temperature sensor (75) for detecting the temperature of refrigerant discharged from the compressors (41, 42), a high-pressure pressure sensor (76) which detects the pressure of refrigerant discharged from the compressors (41, 42) and which constitutes a temperature detecting means, and a high-pressure pressure switch (77).

Each of the indoor units (12, 13) is provided with an inside air temperature sensor (81) for indoor air temperature detection. Each of the indoor heat exchangers (61, 66) is provided with an indoor heat exchanger temperature sensor (82) for heat transfer pipe temperature detection. Provided in portions of the indoor circuit (60, 65) in the vicinity of the upper ends of the indoor heat exchangers (61, 66) are gas side temperature sensors (83).

The controller (90) is configured so as to control the operation of the air conditioning system (10) in response to signals from the above-described sensors and command signals from a remote controller or the like. More specifically, the controller (90) performs: the adjusting of the degree of opening of the outdoor expansion valve (24) and indoor expansion valves (62, 67); the switching of the four-way selector valve (21); and the opening/closing operation of the gas vent solenoid valve (36), oil return solenoid valve (53) and oil-amount averaging solenoid valve (55).

The controller (90) is further provided with a capacity controlling means (91) and a target value adjusting means (92). And, the target value adjusting means (92) includes an air conditioning capacity deciding means (93) and an air conditioning capacity altering means (94).

The capacity controlling means (91) controls the air conditioning capacity of the outdoor unit (11) in such a way that the temperature of refrigerant, which is a refrigerant physical quantity, becomes a target value. More specifically, the capacity controlling means (91) is configured as follows. During cooling mode operations, the capacity controlling means (91) takes a refrigerant evaporating temperature as a target value and controls the air conditioning capacity of the outdoor unit (11) so that a saturation temperature (evaporating temperature) corresponding to an evaporating pressure detected by the low-pressure pressure sensor (74) becomes a target value. Further, the capacity controlling means (91) is configured as follows. During heating mode operations, the capacity controlling means (91) takes a refrigerant condensing temperature as a target value and controls the air conditioning capacity of the outdoor unit (11) so that a saturation temperature (condensing temperature) corresponding to a condensing pressure detected by the high-pressure pressure sensor (76) becomes a target value.

The target value adjusting means (92) is configured such that the target value of the capacity controlling means (91) is altered. That is, the target value adjusting means (92) is configured so as to predict the load characteristics of a building in which the air conditioning system (10) has been installed, for altering the target value.

Because of this, the deciding means (93) determines the control characteristics of the target value correspondingly to the air conditioning load characteristics of the building. More specifically, the deciding means (93) is configured so as to determine the control characteristics of the target value of the evaporating temperature during cooling mode operations. Also, the deciding means (93) is configured so as to determine the control characteristics of the target value of the condensing temperature during heating mode operations. Control characteristic determination by the deciding means (93) may be carried out either manually or by learning.

Further, the altering means (94) variably alters, according to the control characteristic determined by the deciding means (93) and based on the temperature difference between a set temperature of a room as an air conditioning space and the temperature of outside air which is an outside temperature, the target value. More specifically, the altering means (94) is configured so as to variably alter the target value of the evaporating temperature during cooling mode operations. Also, the altering means (94) is configured so as to variably alter the target value of the condensing temperature during heating mode operations.

A basic principle of variably controlling the aforementioned evaporating and condensing temperatures will be described below.

Figure 2:
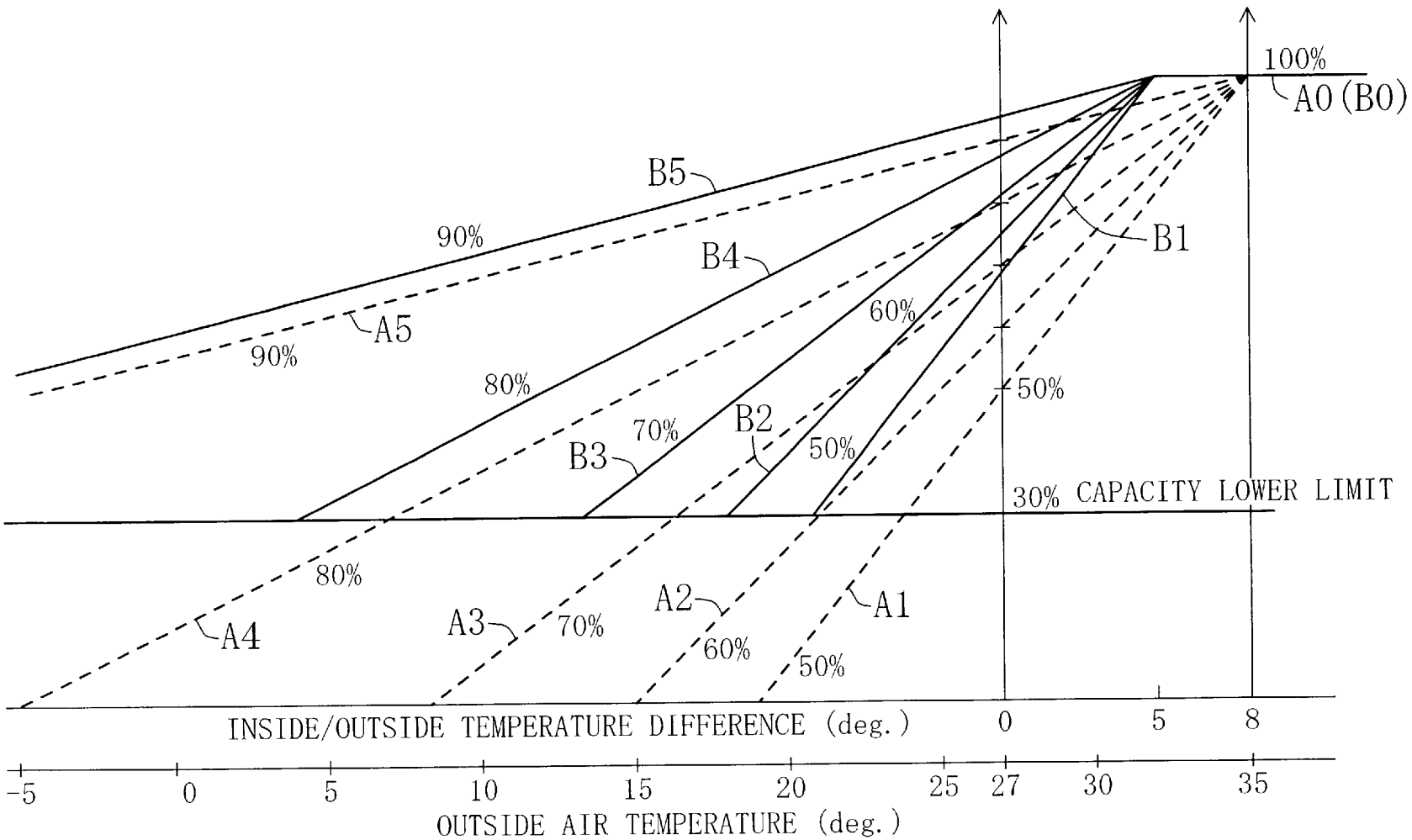
FIG. 2 is a characteristic diagram showing the load characteristics of cooling of a building.

FIG. 2 shows the cooling load characteristics of buildings in which the air conditioning system (10) is installed. That is, each building has its own inherent load characteristics, and the load characteristics of each building are determined based on the amount of internal heat generation and the amount of external heat. Therefore, the cooling load characteristics shown in FIG. 2 show the amounts of internal heat generation such as personal computer equipment or the like. FIG. 2 shows load characteristics (A1–A5) by ratio of the capacity required for actual cooling with respect to a cooling capacity (A0, B0) of 100% which is a rated capacity of the air conditioning system (10).

For example, if the indoor set temperature is 27 degrees Centigrade (which is a standard state) and if the outside air temperature is also 27 degrees Centigrade, then the inside/outside temperature difference is zero degrees Centigrade. In such a condition, if an internal heat generation amount, such as personal computer equipment, does not exist at all, there is no cooling load, and the cooling capacity of the air conditioning system (10) is 0%. Therefore, the operation of the air conditioning system (10) is brought into a halt.

Further, if the indoor set temperature is 27 degrees Centigrade and if the outside air temperature is 35 degrees Centigrade, the inside/outside temperature difference is eight degrees Centigrade, then the air conditioning system (10) needs a cooling capacity of 100%. In other words, in addition to the internal heat generation, there exists, for example, penetrating heat from the outside which is an external heat amount. As a result, the air conditioning system (10) is operated at its maximum capacity (A0, B0).

As described above, the cooling capacity of the air conditioning system (10) is determined by the internal heat generation based on the characteristics of a building and the inside/outside temperature difference.

For example, if, in the above-described state that the inside/outside temperature difference is zero degrees Centigrade, the air conditioning system (10) requires a cooling capacity of 50% (see A1 of FIG. 2), then internal heat generation of for example personal computer equipment becomes a load. This cooling capacity of 50% is consumed to deal with such a load. This building is represented by a 50% load characteristic line (A1).

Each building in which the air conditioning system (10) is installed differs in cooling load characteristics from another building. The buildings are represented by the linear load characteristic lines (A1–A5), respectively.

In FIG. 2, the load characteristic lines (A1–A5) indicated by broken lines represent the load characteristics of the buildings in themselves, and the load characteristics (B1–B5) indicated by solid lines, which take account of the safety factor, represent the load characteristics of the buildings which are imposed on the air conditioning system (10). Therefore, the air conditioning system (10) installed is controlled along a solid-line load characteristic line. Further, a cooling capacity of 30% is set as a capacity lower limit.

Figure 3:
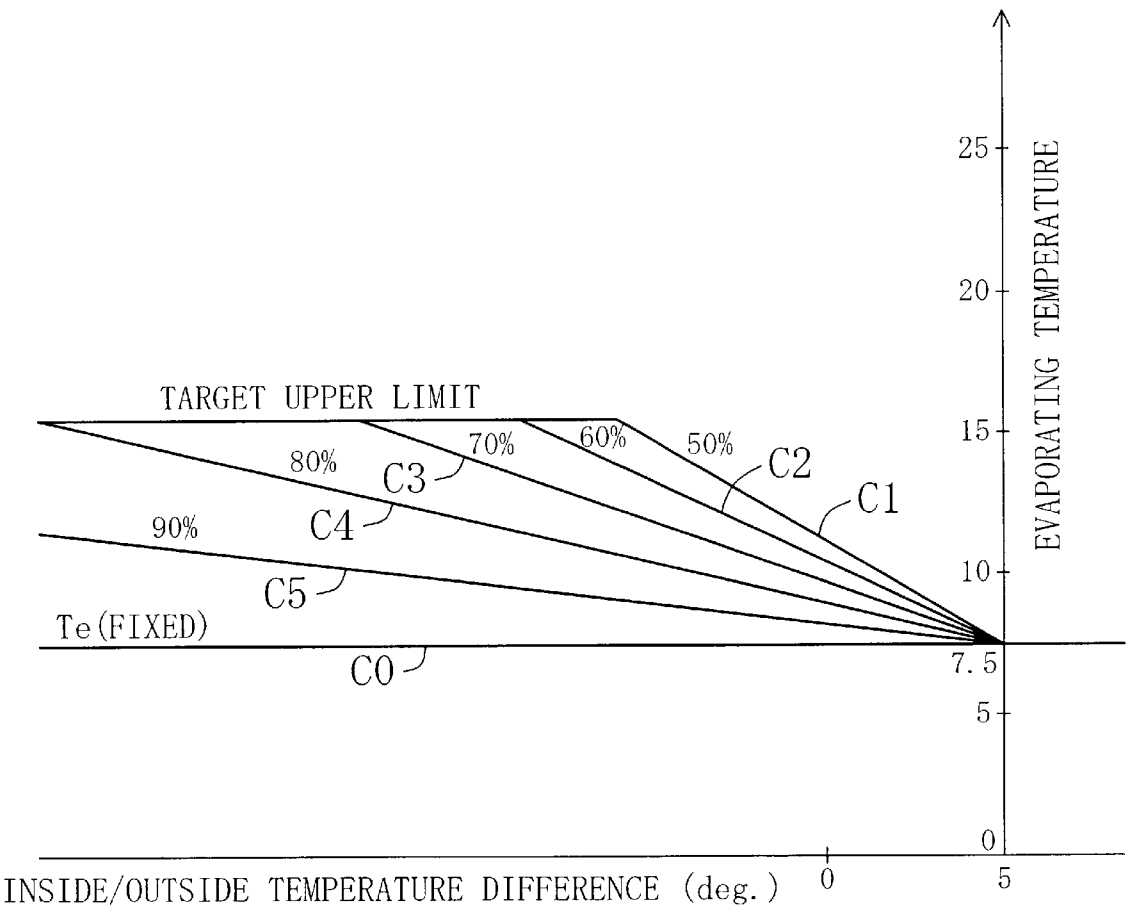
FIG. 3 is a characteristic diagram showing the control characteristics of a target value of an evaporating temperature during cooling mode operations.

FIG. 3 shows control characteristics (C1–C5) of the target value of the evaporating temperature corresponding to the building cooling load characteristics (B1–B5). In other words, the cooling capacity of the air conditioning system (10) is determined correspondingly to the building cooling load characteristics (B1–B5), so that a target value of the evaporating temperature for exhibiting such a determined cooling capacity is determined. For example, a building represented by the 50% load characteristic line (B1) can be represented by the 50% control characteristic line (C1). In this way, the respective buildings can be represented by the linear target value control characteristic lines (C1–C5) correspondingly to the load characteristic lines (B1–B5).

For example, for the case of a building of the 50% load characteristic line (C1), the target value of the evaporating temperature is 11 degrees Centigrade if the set temperature and the outside air temperature are the same, and the air conditioning system (10) operates at a cooling capacity of 50%. And, for the case of a building of the 50% load characteristic line (B1), the evaporating temperature target value is altered, based on the inside/outside temperature difference, along the control characteristic line (C1).

For example, when the set temperature and the outside air temperature are the same, the outdoor unit (11) controls the capacity of both the compressors (41, 42) in order that the evaporating temperature may become eleven degrees Centigrade. Further, a target upper limit of the evaporating temperature target value is set.

Figure 4:
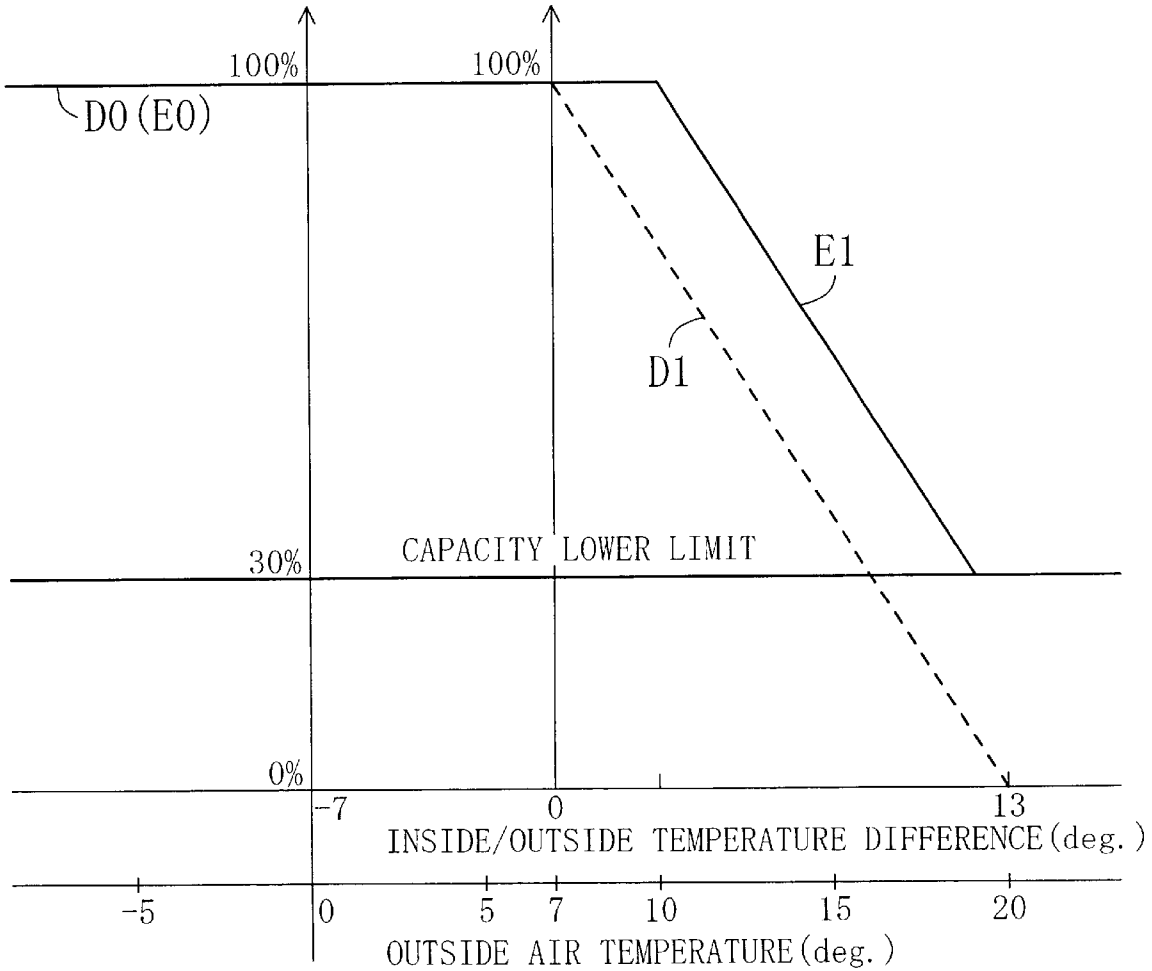
FIG. 4 is a characteristic diagram showing the load characteristics of heating of a building.

The same that has been applied to the cooling is applicable to the heating. FIG. 4 shows the heating load characteristics of buildings in which the air conditioning system (10) is installed. That is, the heating load characteristics shown in FIG. 4 represent building internal heat generation amounts such as personal computer equipment. And, FIG. 4 shows a load characteristic (D1) represented by ratio of the capacity required for actual heating to the case where the air conditioning system (10) operates at a capacity of 100% heating capacity (D0, E0) which is a rated capacity thereof.

For example, when the indoor set temperature is seven degrees Centigrade and the outside air temperature is seven degrees Centigrade, the inside/outside temperature difference is zero degrees Centigrade. In such a condition, if an internal heat generation amount, such as personal computer equipment, does not exist, there is only transmission of heat to the outside and the heating capacity of the air conditioning system (10) is 100%. The air conditioning system (10) will be operated at its maximum capacity (D0, E0).

If the indoor set temperature is higher than the outside air temperature, this produces an inside/outside temperature difference, and internal heat generation is added to the transmission of heat (which is an external heat amount) to the outside. As a result, the air conditioning system (10) will be operated at a capacity less than the maximum capacity (D0, E0).

In the way as described above, the heating capacity of the air conditioning system (10), is determined by the internal heat generation based on the characteristics of a building and the inside/outside temperature difference. In other words, each building in which the air conditioning system (10) is installed differs in heating load characteristics from every other building and is represented by the linear load characteristic line (D1).

In FIG. 4, the load characteristic line (D1) indicated by a broken line represents the load characteristics of the buildings in themselves, and the load characteristic line (E1) indicated by a solid line takes account of the safety factor and represents the load characteristics of the buildings which are imposed on the air conditioning system (10). Therefore, the air conditioning system (10) installed is controlled along the solid-line load characteristic line (E1). Further, a heating capacity of 30% is set as a capacity lower limit.

Figure 5:
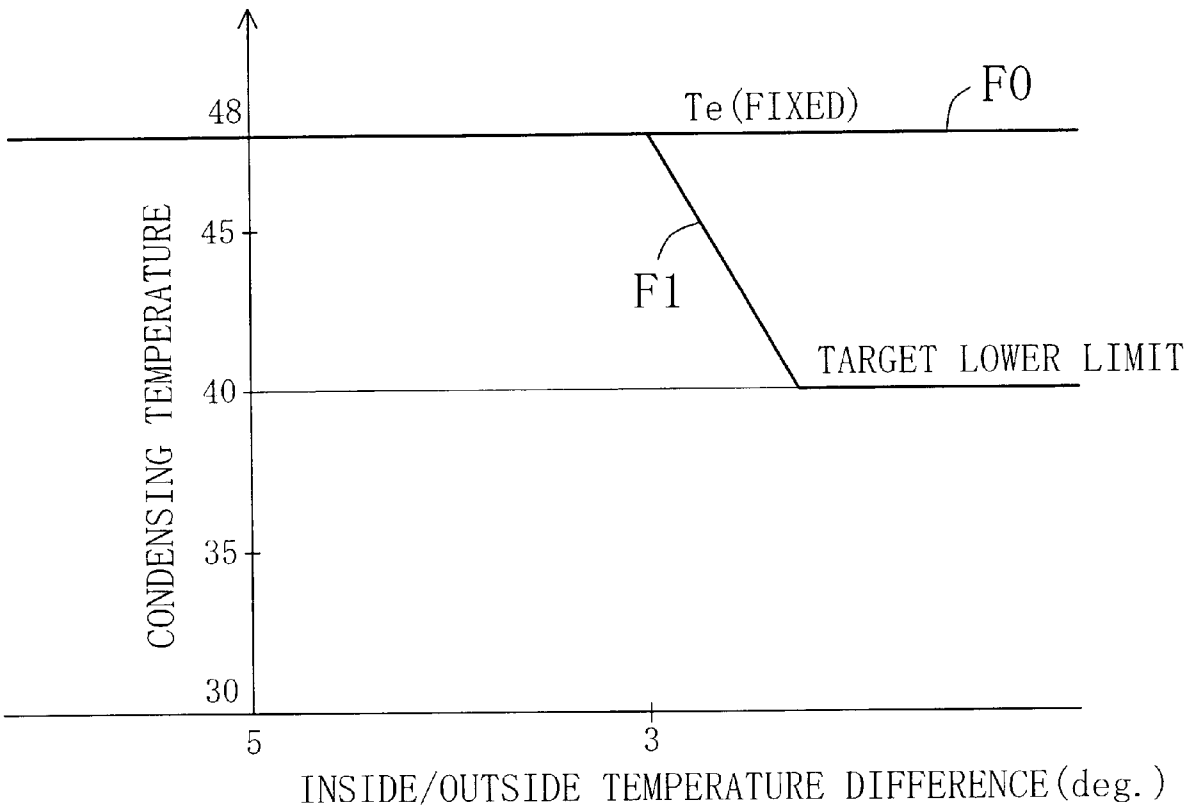
FIG. 5 is a characteristic diagram showing the control characteristics of a target value of a condensing temperature during heating mode operations.

FIG. 5 shows a control characteristic (F1) of the target value of the condensing temperature corresponding to the building heating load characteristic(E1). In other words, the heating capacity of the air conditioning system (10) is determined correspondingly to the building heating load characteristics (E1), so that a target value of the condensing temperature for exhibiting such a determined heating capacity is determined. In this way, the respective buildings can be represented by the linear target value control characteristic line (F1) correspondingly to the load characteristic line (E1).

For example, for the case of a building of the load characteristic line (E1), based on the inside/outside temperature difference, the target value of the condensing temperature is altered along the control characteristic line (F1) in order that the air conditioning system (10) may exhibit a heating capacity to the load characteristic line (E1). More specifically, the air conditioning system (10) controls the capacity of both the compressors (41, 42) so that the condensing temperature is along the control characteristic line (F1). Further, a target lower limit of the condensing temperature target value is set.

Next, the learning control of the deciding means (93) will be described.

The deciding means (93) is configured so as to set the control characteristics of the target value by leaning according to the number of times air conditioning operation is brought to a halt. A halt in cooling and heating operation is a so-called "thermo off" state in which an indoor fan is driven and refrigerant circulation halts. On the other hand, if the refrigerant circulation is resumed from such a halt state, this is a so-called "thermo on" state in which cooling or the like is in operation.

Figure 6:
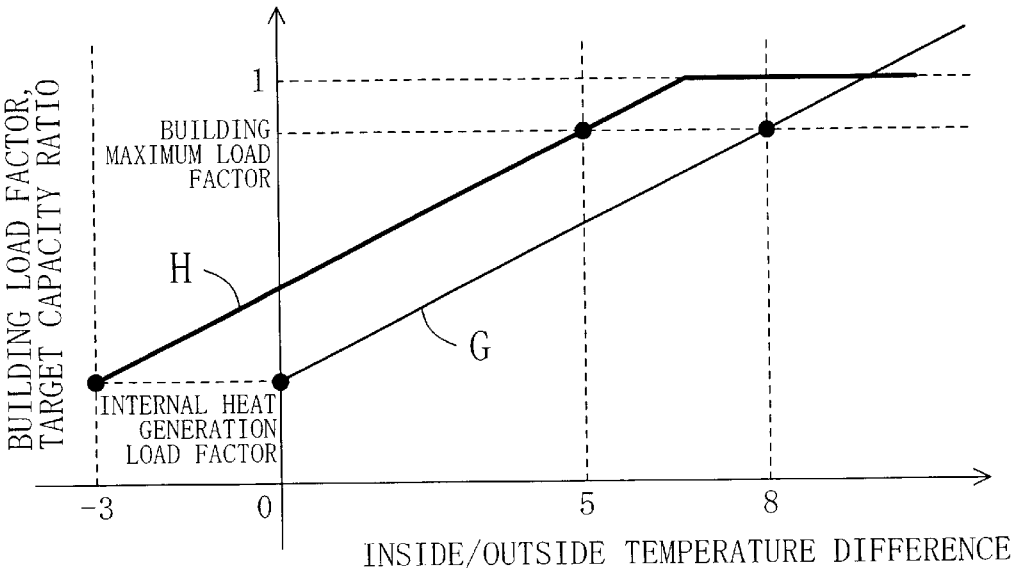
FIG. 6 is a characteristic diagram showing a load characteristic versus control characteristic relationship during cooling mode operations.
Figure 7:
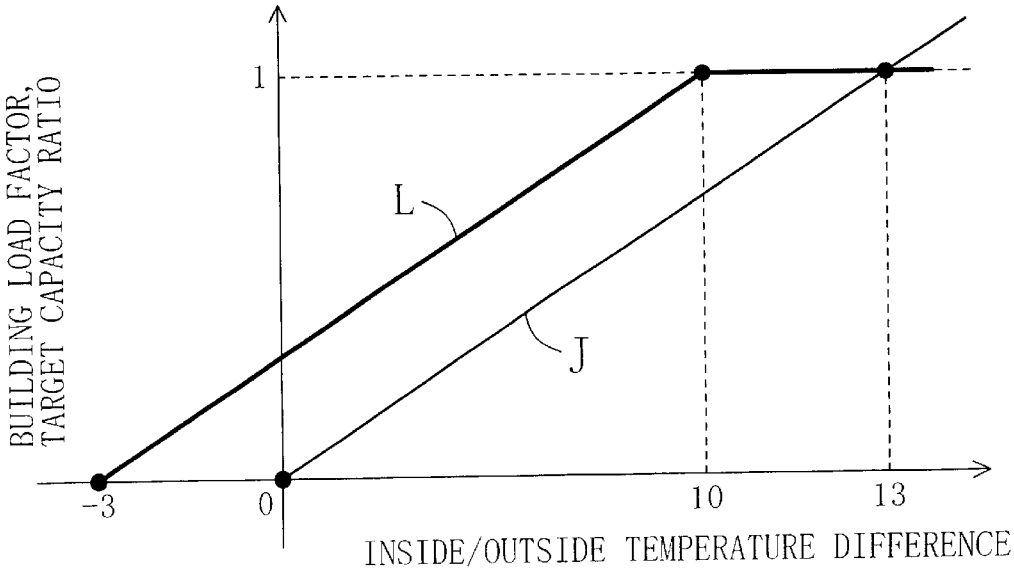
FIG. 7 is a characteristic diagram showing a load characteristic versus control characteristic relationship during heating mode operations.

FIG. 6 shows learning control during cooling mode operations. FIG. 7 shows learning control during heating mode operations. In FIG. 6, it is sufficient that the cooling capacity of the air conditioning system (10) be altered so as to conform to a building load characteristic line (G). The capacity characteristic line (G) indicated by a solid line is for example an initial characteristic line set at the time of installation and is a building load factor.

The deciding means (93) alters, based on the number of times the "thermo off" state occurs during cooling mode operations, a capacity characteristic line (H), to determine a target value of the evaporating temperature. Like the building load characteristic line (G), the capacity characteristic line (H) is linear. Therefore, if the capacity characteristics of two points differing in the inside/outside temperature difference are determined, this determines the capacity characteristic line (H). The capacity characteristic line (H) is a ratio with respect to a capacity of 100% and is a capacity target ratio.

Further, the same is applicable to the heating. In FIG. 7, it is sufficient that the heating capacity of the air conditioning system (10) be altered so as to conform to a building load characteristic line (J). The capacity characteristic line (J) indicated by a solid line is for example an initial characteristic line set at the time of installation and is a building load factor.

The deciding means (93) alters, based on the number of times the "thermo off" state occurs during heating mode operations, a capacity characteristic line (L), to determine a target value of the condensing temperature. Like the building load characteristic line (J), the capacity characteristic line (L) is linear. Therefore, if the capacity characteristics of two points differing in the inside/outside temperature difference are determined, this determines the capacity characteristic line (L). The capacity characteristic line (L) is a ratio with respect to a capacity of 100% and is a capacity target rate.

Figure 8:
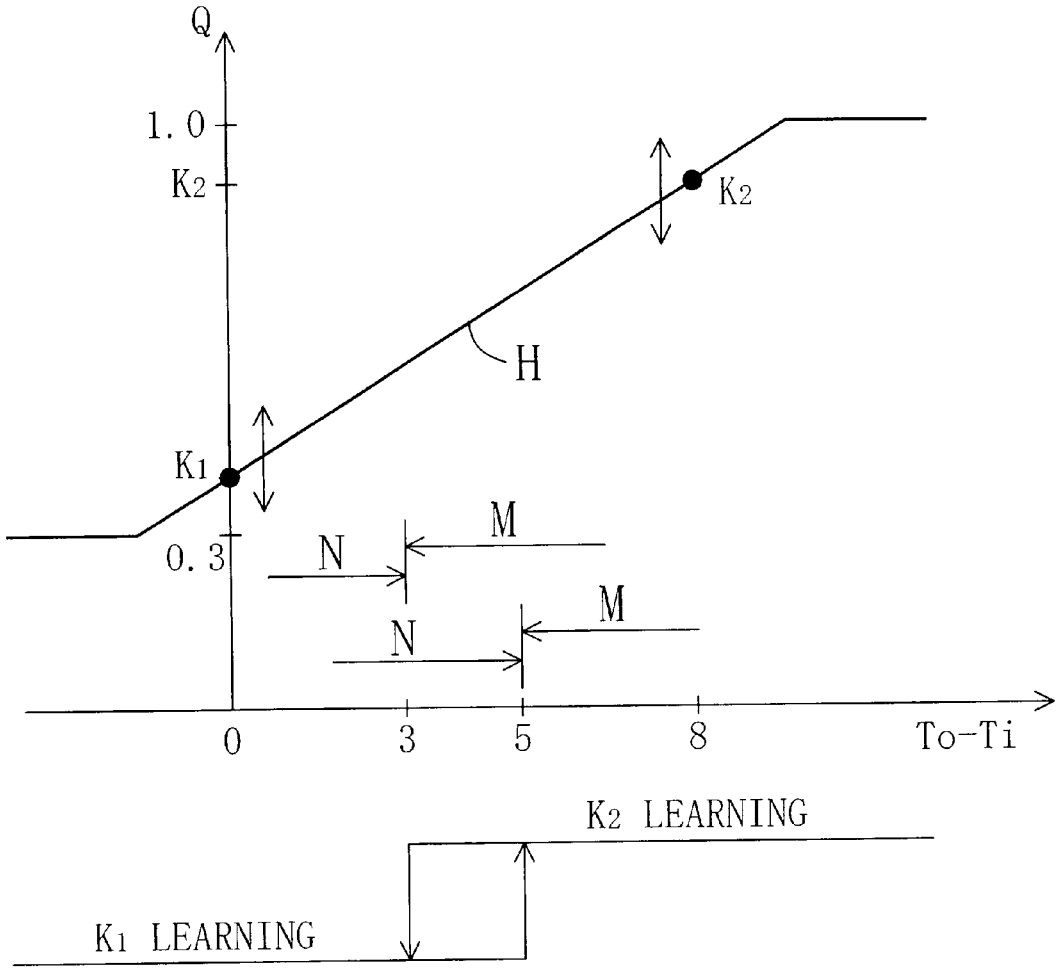
FIG. 8 is a control characteristic diagram showing the learning of the control characteristics of a target value during cooling mode operations.

The principle of learning for example during cooling mode operations will be described. As shown in FIG. 8, a region M where the difference between inside and outside temperature increases by more than five degrees Centigrade and thereafter decreases by less than three degrees Centigrade, and a region N where the inside/outside temperature difference decreases by less than three degrees Centigrade and thereafter increases by more than five degrees Centigrade, are set.

The number of times the "thermo off" state occurs in the region M is counted, and if the "thermo off" state often occurs, a capacity value (K2) at a specified value (eight degrees Centigrade) of the preset inside/outside temperature difference is decreased. On the other hand, if no "thermo off" state occurs, then the capacity value (K2) is increased.

Further, the number of times the "thermo off" state occurs in the region N is counted, and if the "thermo off" state often occurs, a capacity value (K1) at a specified value (zero degrees Centigrade) of the preset inside/outside temperature difference is decreased. On the other hand, if no "thermo off" state occurs, then the capacity value (K1) is increased.

When these two points (K1, K2) of the regions M and N are determined, the capacity characteristic line (G) can be determined. The number of times the "thermo off" state occurs is a count for one hour during heating mode operations, and ideally the smallest possible "thermo off" count is preferable.

Operation

Hereinafter, the operation of the air conditioning system (10) will be described.

In the air conditioning system (10), refrigerant circulates in the refrigerant circuit (15) while undergoing a change of phase, and switching between a cooling mode operation and a heating mode operation is carried out.

Cooling Mode Operation

During cooling mode operations, cooling operation, in which each indoor heat exchanger (61, 66) acts as an evaporator, is carried out. In such cooling operation, the four-way selector valve (21) is placed in the state indicated by a solid line of FIG. 1. Further, the outdoor expansion valve (24) is fully opened, and the degree of opening of the first indoor expansion valve (62) and that of the second indoor expansion valve (67) are adjusted to respective specified values. The gas vent solenoid valve (36) remains in the closed state, and the oil return solenoid valve (53) and the oil amount averaging solenoid valve (55) are adequately opened and closed.

When the compressors (41, 42) of the compressor unit (40) are in operation, refrigerant compressed in each of these compressors (41, 42) is discharged to the discharge pipe (44). The refrigerant, after passing through the four-way selector valve (21), flows in the outdoor heat exchanger (22). In the outdoor heat exchanger (22), the refrigerant gives off the heat to outdoor air and then condenses. The refrigerant thus condensed flows through the first branch pipe **(30*a*) of the inflow pipe (30), passes through the first inflow check valve (31), and flows into the receiver (23). Thereafter, the refrigerant leaves the receiver (23), flows through the outflow pipe (33), passes through the outflow check valve (34), and flows into the liquid side connecting pipe (16)**.

After having flowed through the liquid side connecting pipe (16), the refrigerant diverges into two flows one of which enters into the first indoor circuit (60) and the other of which enters into the second indoor circuit (65). In the indoor circuit (60, 65), the refrigerant is depressurized in the indoor expansion valve (62, 67) and thereafter flows into the indoor heat exchanger (61, 66). In the indoor heat exchanger (61, 66), the refrigerant absorbs heat and then evaporates. In other words, in the indoor heat exchanger (61, 66), indoor air is cooled.

The refrigerants, which have been evaporated in the indoor heat exchangers (61, 66), flow through the gas side connecting pipe (17), merge, and flow into the outdoor circuit (20). Thereafter, the refrigerant passes through the four-way selector valve (21) and the suction pipe (43) and is drawn into the compressors (41, 42) of the compressor unit (40). These compressors (41, 42) each compress the refrigerant drawn thereinto and discharge it again. In the refrigerant circuit (15), such a circulation of refrigerant is repeatedly carried out.

Heating Mode Operation

During heating mode operations, heating operation, in which each indoor heat exchanger (61, 66) acts as a condenser, is carried out. In such heating operation, the four-way selector valve (21) is placed in the state indicated by a broken line of FIG. 1. Further, the outdoor expansion valve (24), the first indoor expansion valve (62), and the second indoor expansion valve (67) are adjusted to respective specified opening degrees. The oil return solenoid valve (53) and the oil amount averaging solenoid valve (55) are adequately opened and closed. Further, the gas vent solenoid valve (36) is held in the opened state all the time during the heating operation.

When the compressors (41, 42) of the compressor unit (40) are in operation, refrigerant compressed in each of these compressors (41, 42) is discharged to the discharge pipe (44). The refrigerant, after passing through the four-way selector valve (21), flows through the gas side connecting pipe (17) and is distributed to each indoor circuit (60, 65).

The refrigerants, which have flowed into the indoor circuits (60, 65), give off the heat to indoor air and then condense in the indoor heat exchangers (61, 65). In each indoor heat exchanger (61, 65), indoor air is heated by heat given off from the refrigerant. The refrigerant condensed is depressurized in each indoor expansion valve (62, 67), passes through the liquid side connecting pipe (16), and flows into the outdoor circuit (20).

The refrigerant, which has flowed into the outdoor circuit (20), flows through the second branch pipe (30*b*) of the inflow pipe (30), passes through the second inflow check valve (32), and flows into the receiver (23). Thereafter, the refrigerant leaves the receiver (23), flows through the outflow pipe (33), passes through the outdoor expansion valve (24), and flows in the outdoor heat exchanger (22). In the outdoor heat exchanger (22), the refrigerant absorbs heat from outdoor air and then evaporates. The evaporated refrigerant passes through the four-way selector valve (21), passes through the suction pipe (43), and is drawn into the compressors (41, 42) of the compressor unit (40). These compressors (41, 42) each compress the refrigerant drawn thereinto and discharge it again. In the refrigerant circuit (15), such a circulation of refrigerant is repeatedly carried out.

Capacity Control

Figure 9:
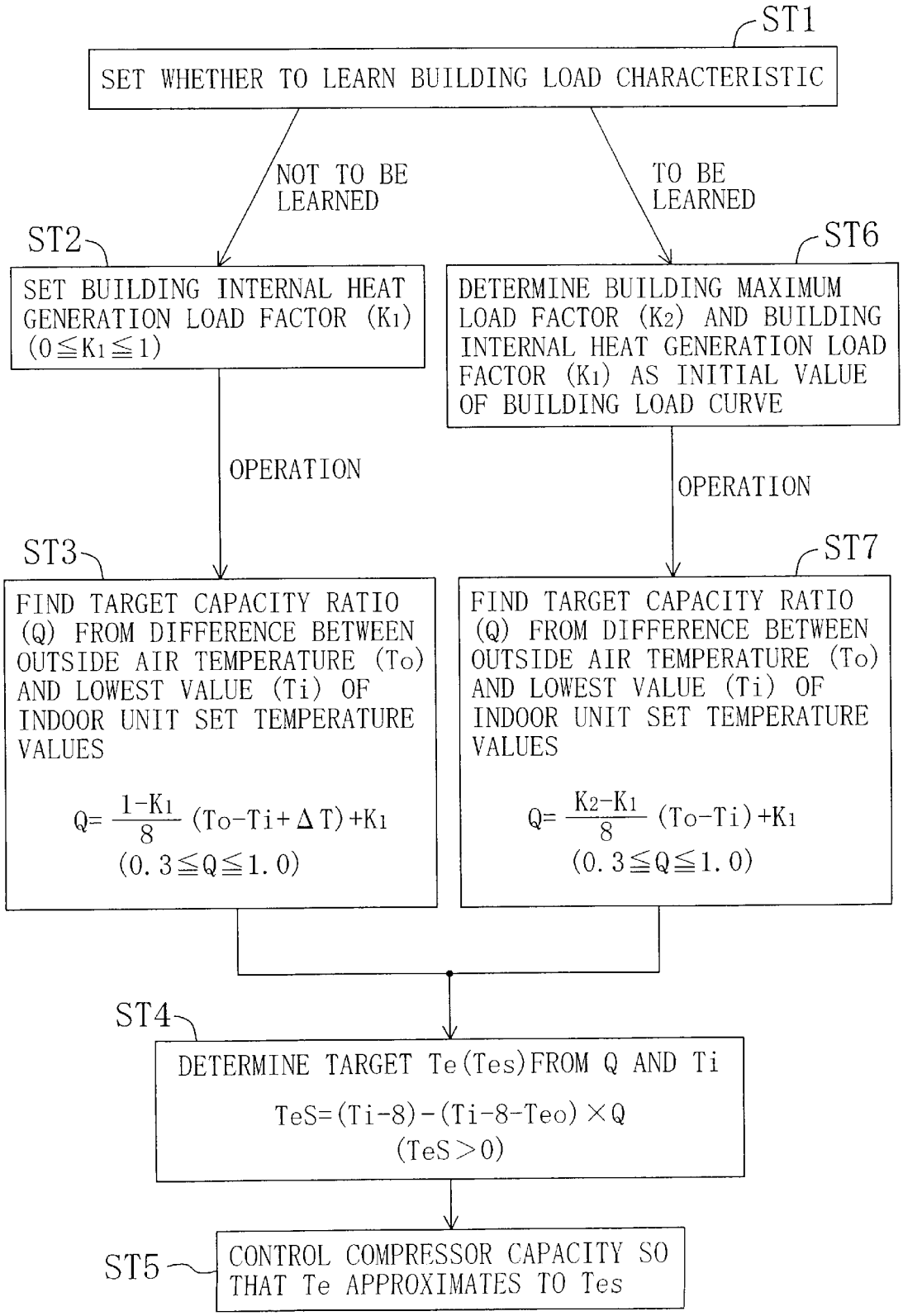
FIG. 9 is a control flow chart showing the controlling of capacity during cooling mode operations.

Referring to FIG. 9, the capacity control of the outdoor unit (11) will be described. FIG. 9 shows a cooling mode operation.

In the first place, in STEP ST1 it is decided whether to learn the load characteristics of a building in which the air conditioning system (10) has been installed, at the time of installation of the air conditioning system (10) or at the time when the air conditioning system (10) is brought into a halt. Such a decision on whether to learn the load characteristics of the building is made, for example by performing a setting on a control part of each indoor unit (12, 13).

If the building load characteristics are not to be learned, the procedure proceeds to STEP ST2. In STEP ST2, an internal heat generation load factor (K1) of the building is set. This internal heat generation load factor (K1) is equivalent to the load characteristics shown in FIG. 2 and is a load characteristic when the inside/outside temperature difference is zero degrees Centigrade.

Next, shifting to the control during cooling mode operations, a target capacity ratio (Q) is calculated in STEP ST3. This target capacity ratio (Q) is equivalent to the capacity characteristics shown in FIG. 4. More specifically, based on the following equation (1), the target capacity ratio (Q) is calculated from the temperature difference between an outside air temperature (To) and a set temperature (Ti) of the lower in set temperature of the indoor units (12, 13).

$$Q=\{(1-K1)/8\}\times(To-Ti\Delta T)+K1 \quad (1)$$

Note that ΔT in Equation (1) is a value corresponding to a safety factor. Further, "8" in Equation (1) is an inside/outside temperature difference in a standard condition. Further, the target capacity ratio (Q) has a value not more than 1.0 nor less than 0.3 ($0.3 \leqq Q \leqq 1.0$). In other words, the target capacity ratio (Q) is so limited as to fall in the range in which efficient operations can be carried out.

Next, the procedure proceeds to STEP ST4. In STEP ST4, an evaporating temperature target value (Tes) is determined based on the target capacity ratio (Q) and the set temperature (Ti).

$$Tes=(Ti-8)-(ti-8-Teo)\times Q \quad (2)$$

Note that the target value (Tes) in Equation (2) is a value not less than zero and is a temperature at which the indoor units (12, 13) will not undergo freezing. Further, "Teo" is an evaporating temperature during rated operation.

Thereafter, the procedure proceeds to STEP ST5 in which the outdoor unit (11) controls the capacity of the compressors (41, 42) in order that the refrigerant evaporating temperature (Te) may become the target value (Tes).

On the other hand, if it is decided in STEP ST1 that the load characteristics of the building are to be learned, then the procedure proceeds to STEP ST6. In this STEP ST2, initial values for the building internal heat generation load factor (K1) and the building maximum load factor (K2) are set. This maximum load factor (K2) is equivalent to the load characteristics shown in FIG. 2 and is a load characteristic when the inside/outside temperature difference is eight degrees Centigrade.

Subsequently, shifting to the control during cooling mode operations, the target capacity ratio (Q) is calculated in STEP ST7. More specifically, based on the following equation (3), the target capacity ratio (Q) is calculated from the temperature difference between the outside air temperature (To) and the set temperature (Ti) of the lower in set temperature of the indoor units (12, 13).

$$Q=\{(K2-K1)/8\}\times(To-Ti)+K1 \quad (3)$$

Note that "8" in Equation (3) is an inside/outside temperature difference in a standard condition. Further, the target capacity ratio (Q) has a value not more than 1.0 nor less than 0.3 ($0.3 \leqq Q \leqq 1.0$), as in STEP ST3.

Next, the procedure proceeds to STEP ST4. In STEP ST4, based on the target capacity ratio (Q) and the set temperature (Ti), the target value (Tes) of the evaporating temperature (Te) is determined from Equation (2) in the same way as described above.

Thereafter, the procedure proceeds to STEP ST5 in which the outdoor unit (11) controls the capacity of the compressors (41, 42) in order that the refrigerant evaporating temperature (Te) may become the target value (Tes).

On the other hand, also during heating mode operations, the target capacity ratio (Q) is calculated, as in the cooling mode operations, and a target value (Tcs) of the condensing temperature is determined. Thereafter, the outdoor unit (11) controls the capacity of the compressors (41, 42) in order that the refrigerant condensing temperature (Tc) may become the target value (Tcs).

Conventionally, both the target value (Tes) of the evaporating temperature (Te) and the target value (Tcs) of the condensing temperature are fixed. On the other hand, as shown in FIGS. 3 and 5, the evaporating temperature (Te) increases from the control characteristic line (C0, F0) and the condensing temperature (Tc) decreases therefrom.

Effects of the Embodiment

As described above, in accordance with the present embodiment, the air conditioning capacity of the outdoor unit (11) is controlled by altering, based on a building air conditioning load, a refrigerant temperature target value. As a result of such arrangement, it is possible to provide an operation corresponding to the building air conditioning load.

To sum up, when it is sufficient for each indoor unit (12, 13) to operate at a small air conditioning capacity, it is possible to cause the outdoor unit (11) to operate also at a small air conditioning capacity.

As a result of the above, each indoor unit (12, 13) is prevented from undergoing an excess of capacity, for example in an intermediate period. Because of this, it is possible to reduce the frequency at each indoor unit (12, 13) repeatedly undergoes the "Thermo off" state and the "thermo on" state. And, it is possible to reduced the variation in indoor temperature, and it is also possible to stabilize the capacity of the compressors (41, 42).

Furthermore, the frequency at which each compressor (41, 42) is repeatedly driven and shut down can be reduced, as a result of which stress which is produced at the time of driving and stopping each compressor (41, 42) can be reduced thereby making it possible to improve the durability of the compressors (41, 42).

Additionally, since it is possible to suppress an excess of air conditioning capacity, this provides improvement in operating efficiency thereby making it possible to provide improvements not only in COP (Coefficient Of Performance) but also in economy.

Further, a target value can be altered based on the difference between a set temperature and an outside air temperature, thereby making it possible to provide an increased air conditioning capacity for example at the beginning of an operation. For example, if the indoor temperature is higher than a set temperature in a cooling mode operation, or if the indoor temperature is lower than a set temperature in a heating mode operation, this increases the difference between the evaporating temperature of refrigerant or the condensing temperature of refrigerant and the temperature of indoor suction air. Therefore it is possible to provide an increased air conditioning capacity. As a result, it is possible to provide improved comfortability.

Further, even when there occurs sudden variation in load, the air conditioning capacity can be increased by making changes in set temperature. This makes it possible to improve comfortability.

Furthermore, when performing air conditioning by introducing outdoor air, the air conditioning capacity varies based on the inside/outside temperature difference, thereby further improving comfortability. For example, the capacity of air conditioning required to meet a set blowout temperature is determined by the difference between the temperature of suction air and the set temperature of blowout air. In accordance with the present invention, the heat source unit (11) is able to control required minimum capacity, thereby making it possible to improve COP and extend the range of controllable operation.

Further, if it is arranged such that the control characteristics of the target value can be manually set, this provides air conditioning capacity to the comfortability of a resident. For example, for the case of a resident who is interested in energy savings, energy-saving operations can be carried out. This certainly provides improvements in economy as well as in comfortability.

Furthermore, if it is arranged such that the target value control characteristics can be learned, then air conditioning capacity corresponding to an air conditioning load of the building can be set automatically. This provides further improvements in economy as well as in comfortability.

Other Embodiments

Although in the above-described embodiment the target value control characteristics are either manually set or learned, the network **(9*b*) which is an external setting means may be used. More specifically, as indicated by a long dashed short dashed line of FIG. 1, an arrangement may be made in which a controller is connected, through the communication line (9*a*), to the network (9*b*) and the control characteristics of a target value are set via the network (9*b*)**.

The target value adjusting means (92) of the above-described embodiment includes the deciding means (93) and the altering means (94). To sum up, it is sufficient for the present invention that target values can be controlled variably. Accordingly, it is sufficient that the target value adjusting means (92) is configured so as to variably control a target value correspondingly to the air conditioning load characteristics of a building. Further, the target value adjusting means (92) may be configured so as to variably control, according to the control characteristics of a target value and based on the difference between the set temperature of an air conditioning space and external temperature, the target value.

Furthermore, for the case of the capacity controlling means (91) and the target value adjusting means (92) of the above-described embodiment, as a target value which is a refrigerant physical amount, evaporating temperature and condensing temperature are used. However, the target value may be an evaporating pressure during a cooling mode operation and a condensing pressure during a heating mode operation detected by the low-pressure pressure sensor (74) and by the high-pressure pressure sensor (76).

Further, these temperature detecting means may be the suction pipe temperature sensor (73) and the discharge pipe temperature sensor (75).

Finally, the air conditioning system (10) may be an air conditioner capable of providing only cooling or an air conditioner capable of providing only heating and the number of compressors may be one.

INDUSTRIAL APPLICABILITY

As described above, the air conditioning system of the present invention is useful for building air conditioning or the like and is particularly suitable when provided with a plurality of indoor units.

What is claimed is:

1. An air conditioning system for providing air conditioning, said air conditioning system comprising:

a refrigerant circuit formed by connection of a heat source unit and a plurality of utilization units, wherein the air conditioning capacity of said heat source unit is controlled such that a physical quantity of refrigerant circulating through said refrigerant circuit becomes a target value, said target value is altered and set, and during cooling mode operations said refrigerant quantity is an evaporating pressure.

2. An air conditioning system for providing air conditioning comprising a refrigerant circuit formed by connection of a heat source unit and a plurality of utilization units, said air conditioning system further comprising:

capacity controlling means for controlling the air conditioning capacity of said heat source unit so that a physical quantity of refrigerant becomes a target value, and target value adjusting means for altering said target value of said capacity controlling means, wherein during cooling mode operations said refrigerant quantity is an evaporating pressure.

3. The air conditioning system of claim 2, wherein said target value adjusting means is configured so as to variably control said target value correspondingly to the air conditioning load characteristics of a building.

4. The air conditioning system of claim 2, wherein said target value adjusting means is configured so as to variably control, according to the control characteristics of said target value and based on the temperature difference between a set temperature of an air conditioning space and an outside temperature, said target value.

5. The air conditioning system of claim 2, wherein said target value adjusting means includes deciding means for determining the control characteristics of said target value correspondingly to the air conditioning load characteristics of a building, and altering means for variably controlling, according to said target value control characteristics determined by said deciding means and based on the temperature difference between a set temperature of an air conditioning space and an outside temperature, said target value.

6. The air conditioning system of either claim 3 or claim 5, wherein said building load characteristics are determined based on the amount of internal heat generation of said building and the amount of external heat.

7. An air conditioning system for providing air conditioning comprising a refrigerant circuit formed by connection of a heat source unit and a plurality of utilization units, said air conditioning system further comprising:

capacity controlling means for controlling the air conditioning capacity of said heat source unit so that a physical quantity of refrigerant becomes a target value, and target value adjusting means for altering said target value of said capacity controlling means, wherein said target value adjusting means is configured so as to variably control said target value correspondingly to the air conditioning load characteristics of a building.

8. An air conditioning system for providing air conditioning comprising a refrigerant circuit formed by connection of a beat source unit and a plurality of utilization units, said air conditioning system further comprising:

capacity controlling means for controlling the air conditioning capacity of said heat source unit so that a physical quantity of refrigerant becomes a target value, and target value adjusting means for altering said target value of said capacity controlling means, wherein said target value adjusting means is configured so as to variably control said target value correspondingly to the air conditioning load characteristics of a building, and said building load characteristics are determined based on the amount of internal heat generation of said building and the amount of external heat.

9. An air conditioning system for providing air conditioning comprising a refrigerant circuit formed by connection of a heat source unit and a plurality of utilization units, said air conditioning system further comprising:

capacity controlling means for controlling the air conditioning capacity of said heat source unit so that a physical quantity of refrigerant becomes a target value, and target value adjusting means for altering said target value of said capacity controlling means, wherein said target value adjusting means includes deciding means for determining the control characteristics of said target value correspondingly to the air conditioning load characteristics of a building, and altering means for variably controlling, according to said target value control characteristics determined by said deciding means and based on the temperature difference between a set temperature of an air conditioning space and an outside temperature, said target value.

10. An air conditioning system for providing air conditioning comprising a refrigerant circuit formed by connection of a heat source unit and a plurality of utilization units, said air conditioning system further comprising:

capacity controlling means for controlling the air conditioning capacity of said heat source unit so that a physical quantity of refrigerant becomes a target value, and target value adjusting means for altering said target value of said capacity controlling means, wherein said target value adjusting means includes deciding means for determining the control characteristics of said target value correspondingly to the air conditioning load characteristics of a building, and altering means for variably controlling, according to said target value control characteristics determined by said deciding means and based on the temperature difference between a set temperature of an air conditioning space and an outside temperature, said target value, and said building load characteristics are determined based on the amount of internal heat generation of said building and the amount of external heat.

11. The air conditioning system of any one of claims 7–10, wherein during cooling mode operations said refrigerant physical quantity is an evaporating pressure.

12. The air conditioning system of any one of claims 7–10, wherein during cooling mode operations said refrigerant physical quantity is an evaporating temperature.

13. The air conditioning system of any one of claims 7–10, wherein during heating mode operations said refrigerant physical quantity is a condensing pressure.

14. The air conditioning system of any one of claims 7–10, wherein during heating mode operations said refrigerant physical quantity is a condensing temperature.

15. The air conditioning system of any one of claims 7–10, wherein the air conditioning capacity of said heat source unit is controlled by controlling the capacity of each compressor of said heat source unit.

16. The air conditioning system of any one of claims 9 and 10, wherein:

temperature detecting means for the detection of refrigerant evaporating temperatures during cooling mode operations is provided, said capacity controlling means, which takes as a refrigerant evaporating temperature a target value during cooling mode operations, is configured to control the air conditioning capacity of said heat source unit so that an evaporating temperature that said temperature detecting means detects becomes said target value, said deciding means of said target value adjusting means is configured so as to determine the control characteristics of said target value of said evaporating temperature, and said altering means of said target value adjusting means is configured so as to variably control said target value of said evaporating temperature.

17. The air conditioning system of any one of claims 9 and 10, wherein:

temperature detecting means for the detection of refrigerant condensing temperatures during heating mode operations is provided, said capacity controlling means, which takes as a refrigerant condensing temperature a target value during heating mode operations, is configured to control the air conditioning capacity of said heat source unit so that a condensing temperature that said temperature detecting means detects becomes said target value, said deciding means of said target value adjusting means is configured so as to determine the control characteristics of said target value of said condensing temperature, and said altering means of said target value adjusting means is configured so as to variably control said target value of said condensing temperature.

18. The air conditioning system of any one of claims 4, 5, 16, 17, and 9, wherein said target value adjusting means is configured such that said target value control characteristics are set manually.

19. The air conditioning system of any one of claims 4, 5, 16, 17, and 9, wherein said target value adjusting means is configured such that said target value control characteristics are set based on an input signal fed from external setting means via a communication line.

20. The air conditioning system of any one of claims 4, 5, 16, 17, and 9, wherein said target value adjusting means is configured such said target value control characteristics are automatically set by learning according to the state of an operation during air conditioning.

21. The air conditioning system of claim 20, wherein said deciding means of said target value adjusting means is configured such that said target value control characteristics are set by learning according to the number of times air conditioning operation halts.

* * * * *

UNITED STATES PATENT AND TRADEMARK OFFICE

CERTIFICATE OF CORRECTION

PATENT NO. : 6,701,732 B2
DATED : March 9, 2004
INVENTOR(S) : Junichi Shimoda

It is certified that error appears in the above-identified patent and that said Letters Patent is hereby corrected as shown below:

Title page,
Item [54], Title, delete "AIR CONDITIONER" and add -- AIR CONDITIONING SYSTEM- --

Signed and Sealed this

Twenty-fourth Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,701,732 B2
DATED : March 9, 2004
INVENTOR(S) : Junichi Shimoda

It is certified that error appears in the above-identified patent and that said Letters Patent is hereby corrected as shown below:

Column 19,
Line 19, delete “beat” and add -- heat --

Signed and Sealed this

Twenty-third Day of November, 2004

JON W. DUDAS
*Director of the United States Patent and Trademark Office*